US005356359A

United States Patent [19]

Simmons

[11] Patent Number: 5,356,359

[45] Date of Patent: Oct. 18, 1994

[54] METHOD AND APPARATUS FOR IMPROVED LOWER BACK EXERCISE

[76] Inventor: Louis J. Simmons, 590 Larcomb Ave., Cols, Ohio 43223

[21] Appl. No.: 73,544

[22] Filed: Jun. 9, 1993

[51] Int. Cl.[5] ..... A63B 21/08

[52] U.S. Cl. ..... 482/97; 482/95; 482/137; 482/142

[58] Field of Search ..... 482/56, 93, 95, 97, 482/100, 105, 123, 137, 142, 148, 907; 128/25 R; 601/34, 35

[56] References Cited

U.S. PATENT DOCUMENTS

| | | | |
|---|---|---|---|
| 3,074,716 | 1/1963 | Mitchel et al. | 482/56 |
| 3,120,954 | 2/1964 | Apostol | 482/97 |
| 3,850,430 | 11/1974 | Hamilton | 482/97 |
| 3,976,058 | 8/1976 | Tidwell | 482/56 |
| 4,292,962 | 10/1981 | Krause | 482/142 |
| 5,035,234 | 7/1991 | Forsythe | 482/142 |
| 5,066,003 | 11/1991 | Jones | 482/142 |

FOREIGN PATENT DOCUMENTS

| | | | |
|---|---|---|---|
| 2633148 | 1/1978 | Fed. Rep. of Germany | 482/137 |
| 91019543 | 12/1991 | World Int. Prop. O. | 482/142 |

*Primary Examiner*—Richard J. Apley
*Assistant Examiner*—Jeanne M. Mollo
*Attorney, Agent, or Firm*—John L. Shailer

[57] ABSTRACT

A lower back exercise and apparatus for correctly performing the exercise. The exercise avoids hyperextension of lower back muscles, tissue and cartilage. The exercise of those areas promotes blood flow to injured muscles and tissue, and encourages healing. The exercise lowers the legs from the horizontal through the vertical rest position, in a total motion substantially greater than 90 degrees, using the same muscle groups to push the legs past the vertical rest position.

7 Claims, 2 Drawing Sheets

METHOD AND APPARATUS FOR IMPROVED LOWER BACK EXERCISE

FIELD OF THE INVENTION

The invention relates to a method for improved lower back exercise and an apparatus for exercising the lower back.

BACKGROUND OF THE INVENTION

Back muscle and cartilage injuries, especially in the lower lumbar region of the back are relatively common. Such injuries are especially common in individuals who, for one reason or another, have failed to maintain the conditioning and tone of the muscles which support the lower back. These muscles, the spinal erectors and hip flexor must be maintained in reasonable condition if such muscle and cartilage injuries are to be protected against.

Additionally, once injury has occurred, healing can be promoted by increasing the flow of blood to the injured muscles and the areas surrounding the injury. Unfortunately, the number and density of blood vessels in the lower back area is relatively low. However, exercise is believed by many to stimulate increased blood flow. A draw back to most forms of exercise is the risk or tendency of hyperextension of the already injured muscles thereby aggravating the injury rather than promoting healing of the muscles, cartilage and surrounding tissues.

There have been a number of attempts to exercise the back and other body parts to increase muscle tone and stimulate the flow of blood to muscles and tissues: U.S. Pat. No. 5,035,234 to Forsythe discloses a back exercise apparatus which includes one section in which the user lies on his side, and a second section attached to the users legs which the user rotates about a vertical axis.

U.S. Pat. No. 5,094,445 to Winkelvoss describes an exercise machine which includes a horizontal torso support from which the legs hang vertically downward. The user then lifts his legs to the horizontal to exercise the lower back.

U.S. Pat. No. 3,120,954 to Apostol discloses an exercise apparatus including a table having a weight bar pendulum attached to one end.

U.S. Pat. No. 4,292,962 to Krause describes a posture treatment apparatus which includes a platform for supporting the users torso in a perpendicular relationship to his legs.

However, none of the previous attempts have met the exercise needs of individuals who have already sustained lower back injuries or whose lower back areas are too out-of-condition to be able to withstand rigorous exercise. In order for exercise to be of value, it must progressively increase in intensity. A common method of increasing the intensity of an exercise is through the use of increased resistance from static weight additions. However, adding weight to an exercise can increase the hyperextension of lower back muscles. Therefore, weight training is not generally recommended for those suffering from lower back muscles, tissue and cartilage injuries.

Therefore, there is a need for a method of exercise and an exercise apparatus that avoids hyperextension of lower back muscles while providing for conditioning and muscle tone, and which can increase local blood circulation to injured muscles and tissues in the lower back. There is also a need for an exercise which can permit progressive intensity of the work out to strengthen lower back muscles, tissues and provide increased blood flow to those areas.

SUMMARY OF THE INVENTION

The instant invention is a method for exercising the lower back and upper legs in which the muscles of the lower back contracted to lift the legs to a horizontal position for a person lying face down, anterior side down, on an apparatus designed to implement the exercise. The apparatus provides for the flexible interconnection and cooperation of the legs with a static weight retaining portion of the apparatus. Because the muscles are contracted only and because the muscles only accomplish the task of lifting the legs against the static resistance of the weights, no hyperextension of the muscles of the lower back occurs, especially the spinal erector and hip flexor muscles of the lower back. The flexible interconnection permits use of the apparatus with optimal benefit for persons of all leg length and body size. The adjustable static weight system further provides a work out level commensurate with the starting strength of each individual and permits weight adjustment to allow for progressively increasing the intensity of the work out as strength increases.

A primary aspect of the present invention is the provision for a method of exercising lower back muscles, even in an individual who has suffered injury to those muscles and surrounding tissue under which the muscles can be vigorously exercised without the risk of hyperextension and subsequent re-injury or aggravation of existing injury.

An additional aspect of the present invention lies in the provision of a flexible interconnection between the weight retaining portion of the apparatus and the legs.

A further aspect of the present invention resides in the provision of an adjustable interconnection means between the weight retaining portion of the apparatus and the legs such that the apparatus easily accommodates a wide range of leg lengths and can be utilized by children as well as adults.

Another aspect of the instant invention is the provision of a pivotable pendulum which retains the static weights, permits the adjustment increase and decrease of static weight used in the exercise, and which retains the flexible interconnection between the weight retaining portion of the apparatus and the legs.

A further aspect of the present invention resides in the provision of the pivotable pendulum to move more than 90 ($\pi/2$ radians) especially at the end of the exercise when the legs are lowered to permit the lowered legs to continue past a lowered vertical position extending the muscles of the upper legs and gluteus maximus without hyperextending the hip flexors and spinal erectors which are supported on a body support platform.

Another aspect of the instant invention resides in the provision of a means for assuring that the exerciser, the person performing the exercise, is only able to push, rather than pull, with the muscle groups targeted by the exercise of this invention.

BRIEF DESCRIPTION OF THE DRAWINGS

The best mode contemplated in carrying out this invention is illustrated and better understood by reference to the following detailed description when considered in conjunction with the accompanying drawings, in which.

DETAILED DESCRIPTION OF THE PREFERRED EMBODIMENTS

Figure 1:
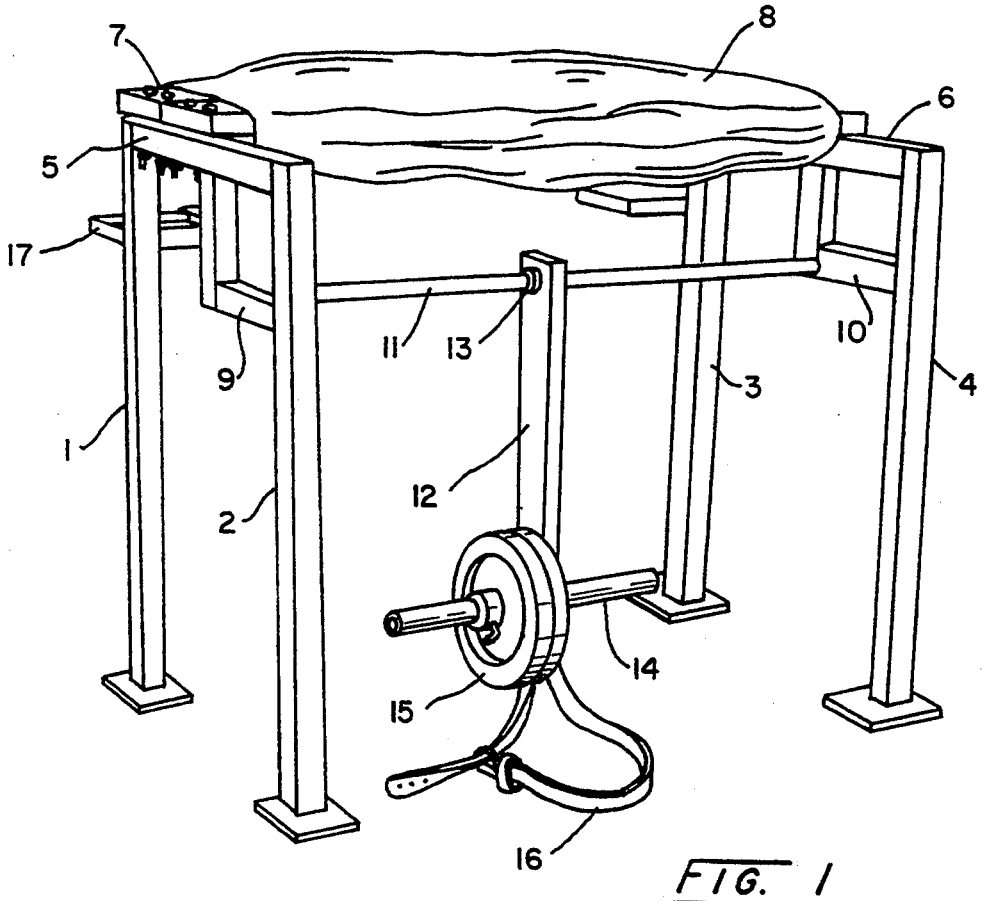
FIG. 1 is a perspective view of an apparatus according to the present invention.

The instant invention is illustrated by FIG. 1, a perspective view of the apparatus used to implement the exercise method of the instant invention. Support legs 1,2,3,4 are connected by support cross pieces 5 and 6, and body support platform 7 to form a support structure. The support structure could be constructed without the inclusion of the body support platform, and a non-structural body support platform than horizontally disposed on the support structure. The structural pieces 1–6 should be made of structural steel sections to provide a very rigid support structure. Movement of the support structure during the exercise is both dangerous and can cause unneeded anxiety in the person who is performing the exercise. It is preferred that a padding 8 provided on the upper surface of the body support platform for the comfort of the person engaging in the exercise method of the instant invention.

Structural support members 9 and 10 add rigidity and strength to the support structure and are also located to retain pivot bar 11 at a point below the body support platform. The pivot bar may be located at any location below the body support platform. But, it is preferred for optimal implementation of the exercise method that the pivot bar be retained at a point below the location of the waist of the person using the apparatus and at a vertical position near the body support platform. In this way, the length of pendulum 12 can be maximized. Pendulum 12 is rotatably retained on pivot bar 11 by pivot means 13 which may be a mere hole in pendulum 12 or a bearing fitted to the pivot bar. Pendulum 12 is freely pivotable about pivot bar 11 from one end as shown.

Located at the other end of pendulum 12 is bar 14 which acts as a weight against which the exercise is performed. Additional weights 15 can be added to bar 14 to permit increasing intensity to the exercise. Bar 14 also provides a place for attaching adjustable strap 16. Adjustable strap 16 may be a leather belt which forms a loop through which the exercising person places their ankles. Adjustable strap 16 provides the flexibility necessary to permit an unrestrained arc of the legs as they move up to the horizontal and back past the vertical during the exercise. This also allows the person to mount the apparatus without the cumbersome situation of having weights attached to the ankles or feet. The static weight of pendulum 12, bar 14 and weights 15, if any do not come into play or weight the ankles until the exercise is begun. Adjustability in strap 16 also permits the loop to be enlarged or reduced for maximum comfort and optimal motion depending on the leg length of the person performing the exercise.

Figure 2:
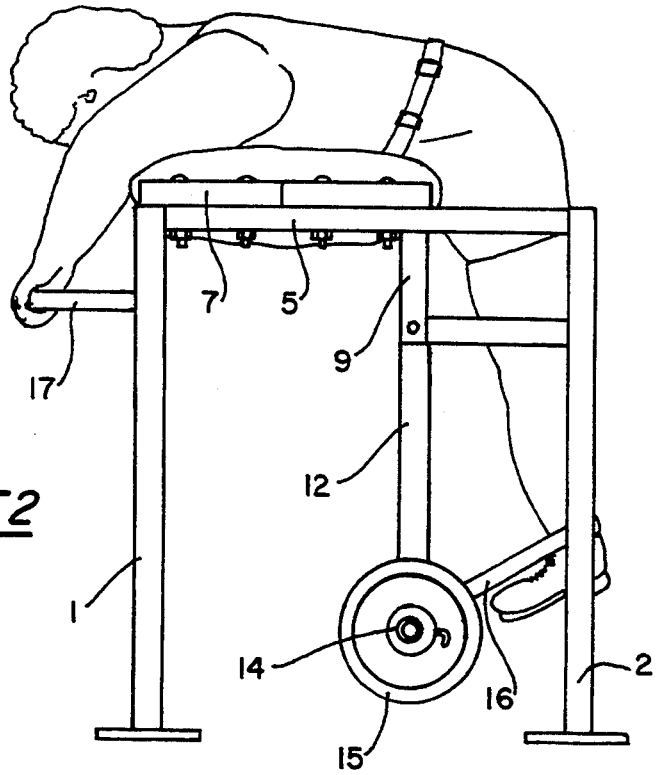
FIG. 2 is a side elevation of an apparatus according to the present invention with a person shown in the proper position to start the exercise of the invention.
Figure 3:
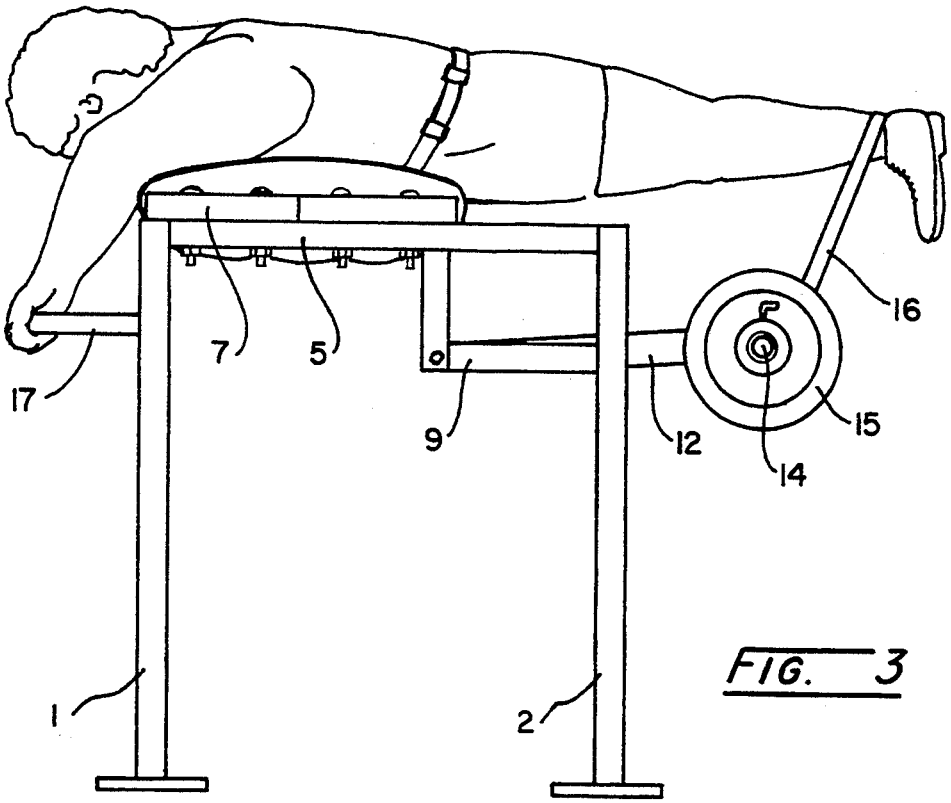
FIG. 3 is a side elevation of an apparatus according to the present invention with a person shown performing the primary action of the exercise method of the invention.
Figure 4:
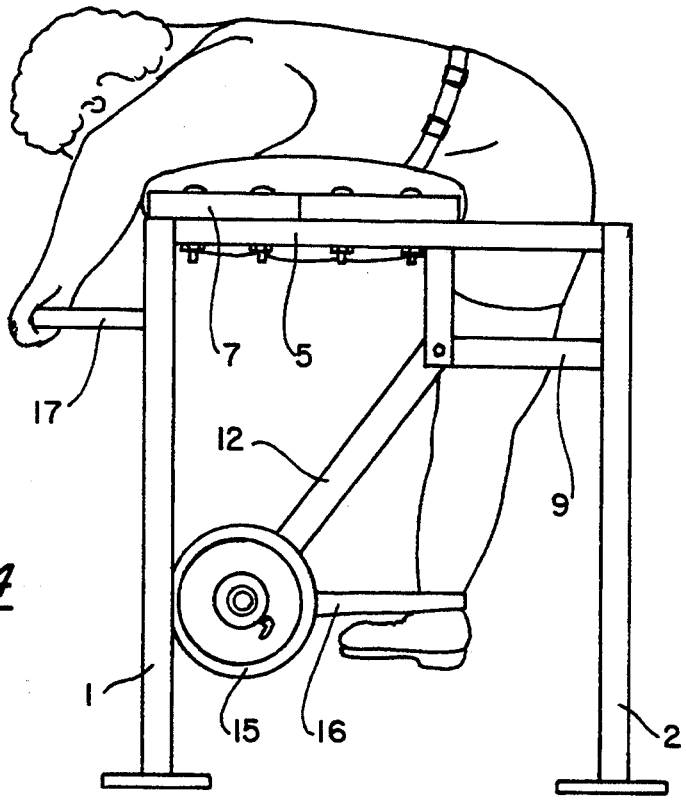
FIG. 4 is a side elevation of an apparatus according to the present invention with a person shown performing the recovery action of the exercise method of the invention.

Turning to FIGS. 2,3, and 4, the entire range of the exercise is illustrated. At FIG. 2, the person to perform the exercise is shown in the proper position (face down or equivalently, anterior side down). The torso to the waist is fully supported by body support platform 7. For comfort and as an aid to mounting the apparatus, handles 17 which are attached to the support structure are provided. The person's ankles are shown through the loop of adjustable strap 16, and weights 15 are shown in place on bar 14. The pendulum is at rest in the vertical position straight below the waist of the person.

The exercise begins by the person contracting the muscles of the lower back (i.e., spinal erectors and hip flexors) and the gluteus maximus. The legs working against the variable combined weight of pendulum 12, bar 14 and weights 15 are moved to the horizontal position as shown in FIG. 3.

The person then lowers the legs, not by simply relaxing the muscles but by lowering the legs using all the muscle groups of the upper legs and lower back. The legs are fully lowered to at least the vertical and then are pushed by muscle action past the vertical as shown in FIG. 4. After the person has pushed the legs as far past the vertical as they can, the exercise begins again by contracting the muscles and pushing the legs back to the horizontal (i.e., FIG. 2). The exercise is then repeated the number of iterations desired by the person exercising.

The exercise is best performed as a smooth continuous action through the iterations. At all points in the exercise, the legs and correspondingly the affected muscles only push and are never pulled from one station to the next. The result is that hyperextension of muscles is avoided and the injured muscles of the lower back are permitted to receive an increase flow of blood. Additionally, in a person with an otherwise healthy lower back, the exercise builds up those lower back muscles thus avoiding future injury.

An additional means may be provided within the apparatus for assuring the exerciser can only push with the target muscle groups is the addition of a counter weighted pulley and cable system (not shown in the drawings) that cooperates with the adjustable strap not only to provide resistance to the initial lifting of the legs to the horizontal position, but also provides static weight resistance to returning the legs to and past the vertical starting position in accordance with the exercise as described above.

Increasing lower back strength is also critical to power lifting. The most common injuries to power lifters are those of the lower back. However, by regularly utilizing the exercise of this invention, persons who lift very heavy weights for sport or in competition, also known as power lifters, can train to greater weight levels while avoiding lower back injuries which are not only counter productive to a proper training program due to lost training time, but also could lead to permanent lower back injuries that are also common among power lifters.

It will be apparent from the above description that this invention provides for a method of exercise and an exercise apparatus for implementing that exercise, in which the muscles of the lower back can be safely exercised and allow for the increased circulation of blood attendant to the proper exercising of all muscles. This increased circulation of blood also promotes healing of damaged or injured muscles and neighboring tissue in the lower back. The exercise further provides for the exercise of these muscles without the danger of hyperextension of the muscles during the exercise. The apparatus also provides for progressively intense work outs by the use of an adjustable strap which engages a variable amount of static weight only after the exercise is commenced.

This invention may be embodied in other specific forms without departing from the spirit or essential characteristics thereof. Present embodiments are therefore considered in all respects as illustrative and not restrictive, the scope of the invention being indicated by the appended claims rather than the foregoing description and drawings, and all changes that come within the meaning and range and equivalency of the claims are therefore intended to be embraced therein.

I claim:

1. An apparatus for exercising the lower back and upper legs comprising:

a support structure;

a horizontally disposed body support platform maintained above the ground by said support structure and which is configured to allow the user's legs to hang freely and vertically down from a first edge of said platform;

a pivot bar horizontally disposed below said body support platform and maintained above the ground by said support structure wherein said pivot bar extends parallel to and below the first edge of said platform;

an adjustable strap which is retained on the opposite end of a pendulum and which retains the legs of the user to transmit the resistance of the pendulum to the user and;

said pendulum which is pivotally connected to said pivot bar with means at one end for engaging and pivoting about said pivot bar, and means at the opposite end of said pendulum for retaining said adjustable strap, wherein the user is able to lift the pendulum by moving the legs from a vertical rest position to a horizontal position and then back to a position beyond the vertical rest position in a total motion substantially greater than a 90 degree arc.

2. An apparatus according to claim 1 wherein said body support platform has padding on the upper surface thereof.

3. An apparatus according to claim 1 wherein said pendulum also has means for retaining weights adjacent to said means for retaining the adjustable strap.

4. An apparatus according to claim 1 wherein said adjustable strap is a leather adjustable belt.

5. A method for exercising the lower back and upper legs comprising the steps of:

disposing a person anterior side down on a body support platform so that the stomach and chest areas are supported and maintained above the ground and such that the legs are not supported by the platform but hang freely and vertically down from the edge of said platform;

maintaining said body support platform above the ground with a support structure, and wherein said support structure retains said body support platform at least high enough that the legs and feet of the person are maintained above the ground;

providing a pivot bar which is horizontally retained by said support structure below the body support platform, said pivot bar being retained perpendicular to the centerline of the person;

providing a pendulum which is pivotally retained at one end by said pivot bar wherein said point of pivotal retention along said pivot bar is substantially below the centerline of said person, and providing the other end of said pendulum with means for retaining an adjustable strap;

providing an adjustable strap retained at one end of said pivot bar wherein said adjustable strap is closed to form a loop;

inserting the legs of the person through the loop of the adjustable strap so that the loop flexibly connects the ankles of the person to the strap retaining means end of the pendulum;

lifting the legs to a horizontal position against the weight resistance of the pendulum by means of the adjustable strap wherein the force of lifting is provided by the contraction of the gluteus maximus, and the erector and flexor muscles of the lower back;

lowering the legs through the vertical rest position and using those same muscle groups to push the legs past the vertical in a total motion substantially greater than 90° repeating the lifting and lowering steps to form an exercise regimen.

6. A method according to claim 5 further comprising the step of providing variable weight amounts to be retained on said pendulum adjacent said adjustable strap retention means.

7. A method according to claim 5 further comprising the step of providing handles for the person to grasp while positioning on the body support platform and to maintain the proper position on the body support platform during the exercise.

* * * * *